United States Patent [19]

Coffey

[11] Patent Number: 4,920,716

[45] Date of Patent: May 1, 1990

[54] VENEER CONSTRUCTION AND METHOD OF ACHIEVING SAME

[76] Inventor: Jess R. Coffey, 25632 Mead St., Loma Linda, Calif. 92354

[21] Appl. No.: 204,377

[22] Filed: Jun. 9, 1988

[51] Int. Cl.[5] ..... E04F 13/08

[52] U.S. Cl. ..... 52/386; 52/387; 52/388; 52/389; 52/391; 52/744

[58] Field of Search ..... 52/388, 389, 390, 391, 52/386, 387, 744

[56] References Cited

U.S. PATENT DOCUMENTS

| | | | |
|---|---|---|---|
| 1,850,961 | 3/1932 | Mortenson . | |
| 1,853,824 | 4/1932 | Krauss . | |
| 1,861,359 | 5/1932 | Pyron . | |
| 1,982,560 | 11/1934 | Williams . | |
| 2,022,363 | 11/1935 | Vertuno . | |
| 3,019,560 | 2/1962 | Hansen | 52/389 |
| 3,077,059 | 2/1963 | Stout . | |
| 3,142,938 | 8/1964 | Eberhardt | 52/391 X |
| 3,148,982 | 9/1964 | Neale | 52/388 X |

*Primary Examiner*—Carl D. Friedman

*Attorney, Agent, or Firm*—John H. Crowe

[57] ABSTRACT

A method of installing facing bricks on the surface of an outer building wall including, as a first step, the attachment to the wall of chicken wire provided with parallel ridge configurations. These configurations are positioned to form horizontal barriers in the chicken wire which are spaced far enough apart to receive the facing bricks between them. The bricks are buttered on one side with mortar, then pressed into position between the barriers with their lower edges adjacent the lower of the two flanking barriers. When the mortar sets, grout is applied to the spaces between the bricks to embed the ridge configurations in the chicken wire. The result is a veneered wall having the bricks fastened to the wall surface with mortar and integrated into a cohesive veneer skin, along with the mortar, chicken wire and grout. Thus, if one or more of the bricks breaks away from the wall through loss of the mortar bond between the bricks and the wall, the chicken wire will hold them in position and prevent them from falling and harming or damaging persons or property below.

15 Claims, 4 Drawing Sheets

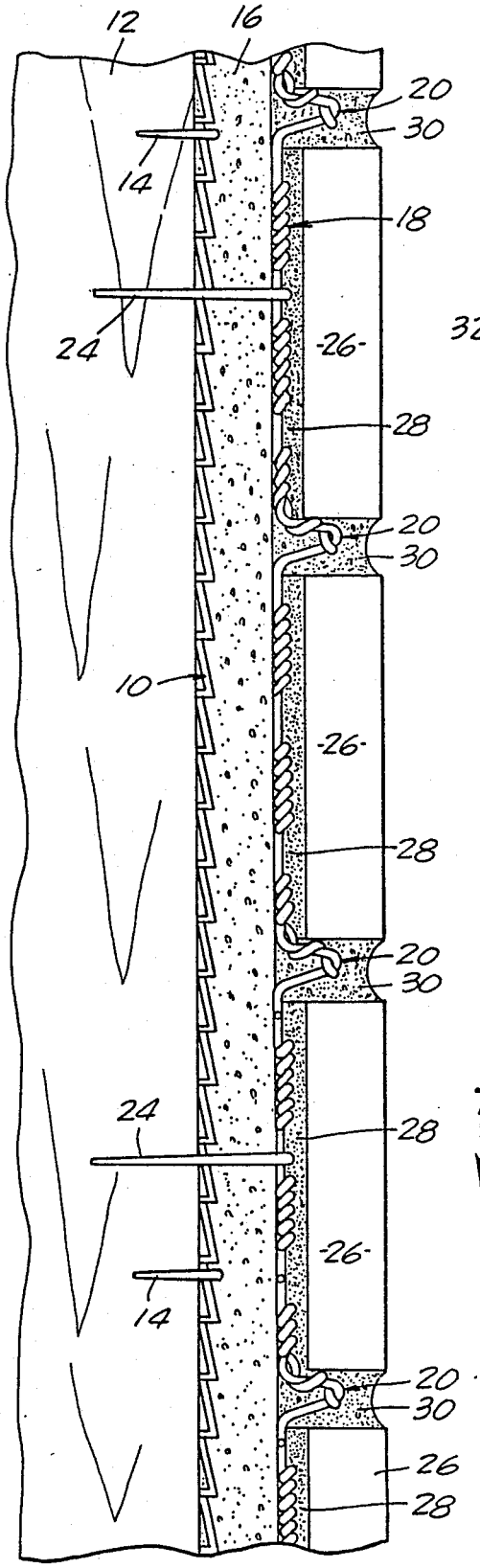
FIG. 3
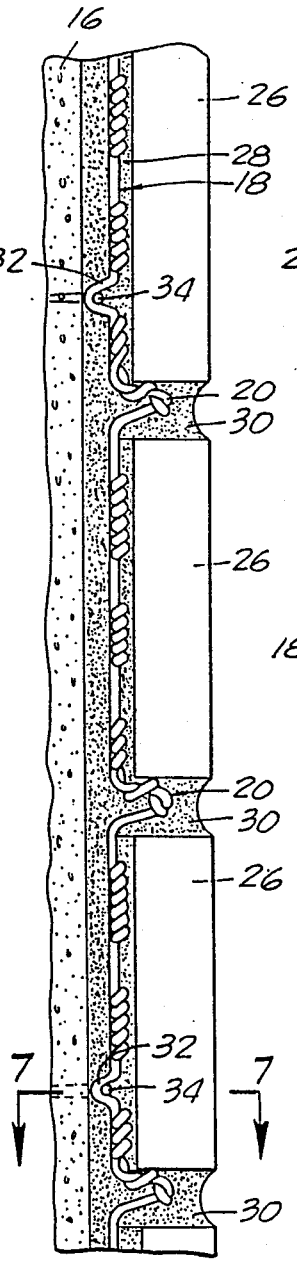
FIG. 6
FIG. 5
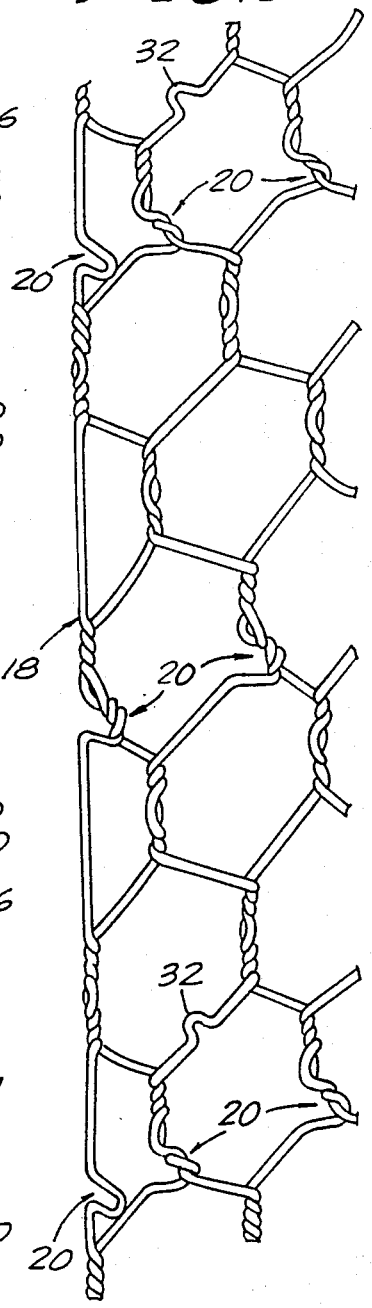
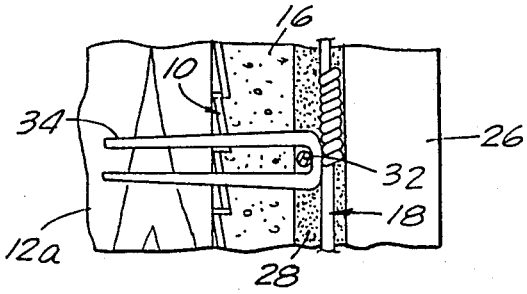
FIG. 7

18a
16
26
40
42
9
10

VENEER CONSTRUCTION AND METHOD OF ACHIEVING SAME

BACKGROUND OF THE INVENTION

1. Field of the Invention

This invention relates generally to novel wall veneer means and more particularly to such means of superior cost and safety effectiveness.

2. Description of the Prior Art

Presently conventional techniques for the attachment of tile, brick, or other veneer facing units to outer building walls are relatively time consuming and require the services of skilled tile setters or the like. Hence such methods are costly. Typically they involve the application of a layer of mortar (bed mortar) to the building wall followed by the spaced setting or laying of the veneer units on the bed mortar and allowing the mortar to set. After the mortar has set, the spaces between the units are generally pointed with grout. There are several ways facing units are presently applied to a wall, all of which require the wall to be worked in a relatively small section at a time, allowing the mortar to set in that section and then going on to work another section. One such method involves the use of a grill removable attachment to the section of wall being worked which divides that section into spaces sized and adapted to receive the individual bricks, or other facing units. After all of the spaces have been filled with the units and the bed mortar has set, the grill is moved to another section and the procedure repeated.

In addition to the slow, tedious and expensive character of presently employed methods of applying tiles, bricks or other facing units to building walls, the veneered walls resulting from such methods present certain safety hazards. Because the facing units are bonded to the building walls only by mortar and held in position by little else, if the mortar bond with the wall gives way behind one or more of the units, there is a tendency for that unit, or units, to become dislodged and fall. The potential hazard to any person underneath the point where such a unit is loosened and falls is obvious, particularly where the wall is high up on a building. Furthermore, property can be damaged by falling bricks, or the like, from high up on veneered building walls. The loosening of such facing units from walls veneered in the presently conventional manner can be brought about by the everyday forces to which building walls, particularly outer walls, are subjected as a result of exposure to wind forces, temperature changes, snow and/or rain, and other normal environmental conditions. When such building walls are subjected to unusually severe forces or conditions, the facing units can come loose to create great harm to life and property. In an earthquake, for example, the rain of bricks, tiles or the like, from veneered building walls on persons and property in the streets below could create great havoc and destruction. In the event of a major fire, a cold stream of water directed by firemen onto veneered wall surfaces heated by the blaze could result in such a severe temperature stock as to again cause the facing units to come loose and fall onto firemen, or others, below.

The prior art of which I am aware has, since at least as early as the 1930s proposed various alternative ways of adding veneer skins to building walls. These various expedients have all involved one or more of three concepts. One concept entails the utilization of metal panels which are pieced together on a wall surface to be veneered and which are provided with spaced clips, tangs or the like positioned to receive facing units therebetween and help to hold the units in place. The panels are first fastened to a wall surface, and the facing units then positioned thereon. Mortar or the like is employed in one way or another in conjunction with these panels. U.S. Pat. Nos. 1,850,961 to Mortenson; 1,861,359 to Pyron and 1,982,560 to Williams show panels exemplary of this concept. Such panels would be difficult and expensive to manufacture today, and therefore not competitive enough with conventional techniques in the building trades to warrant serious consideration by any building contractor or subcontractor. This would have been even more true in the early '30s when these patents issued, because that was during the depths of the depression with very little building activity of any sort going on. Moreover, facing units attached to such panels would be no more resistant to dislodge and fall than facing units installed by the conventional techniques used today. In fact, it seems likely that such panel-mounted bricks, or the like, would be even less stable and secure than the conventionally installed facing units on today's buildings.

A second prior art concept as an alternative to conventional tiling or other facing unit installation techniques requires the use of specialized interfitting hardware and facing units for positioning of the units on some sort of a backing panel or other structure. This concept requires the manufacture of highly specialized hardware parts and facing units or slabs for use in lieu of the mass-produced conventional tiles, bricks, or the like. It also requires the use of mortar to help retain the facing units in position, similarly to conventional tile setting and other veneer installation techniques, and it has never been accepted for widespread usage insofar as I am aware. Perhaps the reason for this has been the higher cost of the hardware and specialized facing units involved and the tedious, time consuming necessity of handling a plurality of hardware items to position them for receiving facing units on a wall to be veneered thereby. U.S. Pat. Nos. 2,022,363 to Vertuno and 3,142,938 to Eberhardt disclose such veneering expedients.

A third prior art concept for alternative wall veneer construction involves the use of simulated brick or other veneer panels or rolls that are attachable to building walls. Such fake veneers employ thin, lightweight slabs simulating bricks or the like and are therefore not true counterparts of veneer skins employing conventional facing units, but "false fronts" simulating the real thing. Moreover, such "veneer" construction materials are, at least in some cases, much flimsier and less durable than true brick, or other, veneer constructions. Examples of patents disclosing materials of this type are U.S. Pat. Nos. 1,853,324 to Krauss and 3,077,059 to Stout. The Krauss patent combines two of the above-mentioned concepts (interfitting panels to be installed on a building wall and the use of thin, simulated blocks, typically ¼- or ⅓-inch thick, thereon). The Stout patent includes a backing of corrugated cardboard, which can be fastened to "wood studdings which are customarily used in wall construction." This apparently limits the type of wall structures on which that veneer material can be used. Moreover, the simulated veneer units of Stout must be fashioned with bore holes to receive wires which are threaded therethrough and interlaced with a wire mesh material forming part of the veneer structure, which adds to the cost of the facing units.

As will be clear from the above, presently conventional techniques for the attachment of facing units to building walls to form tile, brick, or like veneers thereon are relatively costly and leave much to be desired in the way of safety effectivness. Alternatives to these conventional techniques have been proposed since at least the early '30s, but no such alternative has yet succeeded in overcoming the cost and safety disadvantages of the conventional techniques. For the most part, in fact, the alternatives have been even more costly than conventional tile setting and other veneer construction methods.

SUMMARY OF THE INVENTION

I have now, by this invention, provided a relatively low cost alternative to conventional methods of attaching tile, bricks, or the like, to building, or other, surfaces to form a veneer thereon. My method of accomplishing this is basically simple and does not involve any of the above-mentioned prior art concepts. In practice, the technique can be performed more rapidly than conventional tile setting and like procedures for facing building walls with tile or other veneer skins, and it does not require the skills of highly paid tile setters or similar artisans. Even inexperienced workers can practice the method with minimal difficulty. Thus, there are substantial savings in construction costs, by comparison with the cost of conventional veneer construction work, with no sacrifice in the quality of workmanship. Furthermore, veneered walls finished off in accordance with the method of this invention are sturdy and durable and capable of withstanding severe shock forces without dislodging tiles or other facing units. Consequently, such walls are substantially absent the kind of safety hazards from falling tiles or the like that are inherent in walls tiled or otherwise veneered in conventional fashion. My novel method employs standard tiles, bricks, or other facing units and it does not require the use of specially designed pieces of hardware for use in cooperation with individual facing units.

More specifically, in the practice of my method, the first step is preferably the attachment of a layer of reinforcing mesh to the wall, or other surface, to be veneered. The term "reinforcing mesh" is herein employed to include any mesh of the type suitable for use with mortar, plaster or the like to give tensile strength thereto, as exemplified by stucco netting, chicken wire, expanded metal lath, wire fabric, fencing, etc. It is typically formed from metal, but can alternatively be made of plastic or other suitable material. My presently preferred reinforcing mesh is 1-inch, 20-gauge chicken wire. This reinforcing mesh is provided with parallel ridge lines spaced appropriately to receive the facing units in the troughs therebetween, as will be described. It is fastened to a wall to be veneered, which can be of any type, with these ridge lines arranged horizontally so that subsequently placed bricks or other facing units are laid out on the wall in straight lines.

In the next step of the procedure, the facing units are back-buttered with mortar and pressed into place in one of the troughs in the reinforcing mesh with its bottom edge resting against the ridge line below it. Other facing units are similarly buttered and positioned on the wall until the whole wall area under the reinforcing mesh is covered. It usually doesn't matter where this operation is started, because the reinforcing mesh clearly defines the horizontal pathways of the facing units on the wall surface. This technique differs from the conventional way of setting tiles, or the like, which requires that they first be positioned on a wall in a marked out area, then in another area, and so on. The vertical clearance between the spaced ridge lines of my reinforcing mesh is such that the facing units fit fairly snugly thereinto and confine the ridge lines to the horizontal valleys between the units. Finally, these valleys are pointed with grout to embed the ridge lines. If desired, the reinforcing mesh can be provided with properly positioned barriers at the valley areas between the horizontally spaced edges of the facing units. The resulting valleys are also pointed with grout to embed these barriers.

As will now be apparent, building walls veneered in accordance with my novel method are provided with veneered skins adherent to the wall surfaces by means of mortar which is pressed through and embeds my reinforcing mesh when facing units are pressed in place on the wall, and is held together by the reinforcing mesh thus embedded and the grout between the facing units. Additionally, the reinforcing mesh is firmly fastened to an underlying wall by staples, screws, or the like, depending upon the type of wall (stucco, steel-framed, wood, etc.) involved. Consequently, even if a number of these facing units separate from the wall surface because of loosening of the mortar bond therewith, they will not fall, but will be retained in position by the embedded reinforcing mesh typing everything together.

It is thus a principal object of this invention to provide a technique for the attachment of facing units to building walls to form a veneer covering for the walls which is substantially more cost effective than conventional veneering techniques.

It is still another object of the invention to provide such a technique utilizing conventional facing units.

It is still another object of the invention to provide tile, brick, or the like veneers on building walls that are durable and substantially free of any risk of injury to persons or damage to property from falling tiles or other objects, even when subjected to unusual stresses.

Other objects, features and advantages of the invention will become apparent in the light of subsequent disclosures herein.

BRIEF DESCRIPTION OF THE DRAWINGS

FIG. 3 is a fragmentary sectional view of the veneered wall of FIG. 1, taken along line 3—3 of FIG. 1.

FIG. 5 shows a section of chicken wire similar to that of FIG. 2, except with dimples formed therein to permit attachment of the wire to a building wall in slightly spaced relationship therewith to achieve a furring effect.

FIG. 6 is a fragmentary sectional view of a wall that has been veneered in accordance with the method of this invention utilizing the chicken wire shown in FIG. 5.

FIG. 7 is an enlarged fragmentary sectional view of the FIG. 6 wall, taken along line 7—7 of FIG. 6.

DESCRIPTION OF THE PREFERRED EMBODIMENTS

Figure 1:
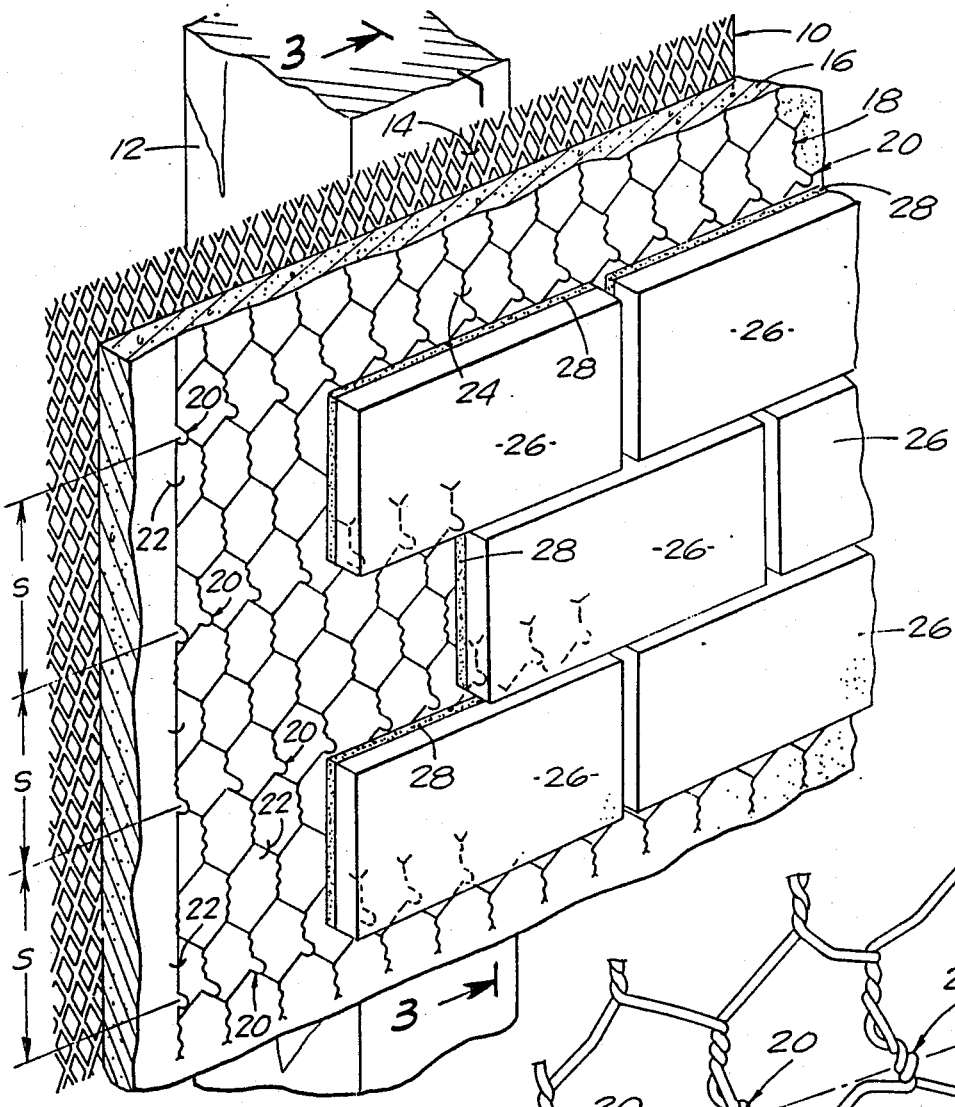
FIG. 1 is a fragmentary isometric view of a section of wall with brick veneer in accordance with this invention under partial construction thereon.
Figure 2:
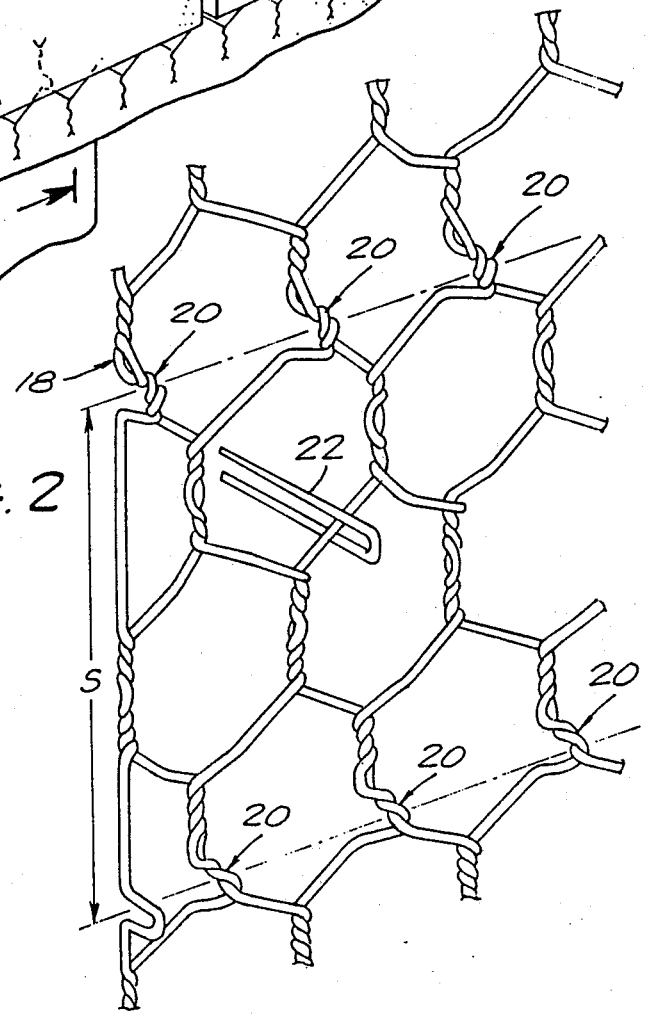
FIG. 2 is an enlarged fragmentary portion of chicken wire specially formed for purposes of this invention and showing a staple for use in attaching the wire to a building wall.

Considering now the drawings in greater detail, with emphasis first on FIGS. 1 and 3, there is shown a fragmentary section of wall to illustrate a brick veneer finish in accordance with this invention, FIG. 1 showing the wall with the veneer partially completed and FIG. 3 showing a cross section of the finished wall. The illustrated wall is a conventional stucco wall in which an expanded metal lath backing 10 is fastened to wall frame studs, one of which is shown at 12, with staples 14 and overlaid with a layer of stucco 16. Fastened to the outer surface of stucco 16 is a layer of chicken wire 18 having spaced horizontal ridge lines 20 formed therein. Chicken wire 18 is secured in position on the stucco by means of staples, some driven into the stucco, as indicated at 22 in FIG. 1, and other, longer ones driven through the stucco and into the studs, such as illustrated at 24 in FIG. 3. FIG. 2 shows an enlarged segment of the chicken wire between a pair of ridge lines 20 and one of the staples 22 positioned for attaching the chicken wire to stucco 16. The doubleheaded arrows S in FIGS. 1 and 2 serve to indicate the spacing between the rows of parallel ridge lines 20 in chicken wire 18.

When chicken wire 18 is in position as described, the wall is ready to receive tiles, bricks, or other facing units of a size to fit easily within the spaces between the ridge line formations 20 in the chicken wire in the manner best illustrated in FIG. 1, which shows several bricks 26 so positioned. The preferred way of laying the bricks on the wall is to butter one side with mortar and then press that side in proper position on the wall over the chicken wire. The mortar thus works its way around the meshes of the wire to embed it. Such mortar is shown at 28 in FIGS. 1 and 3. As will be apparent, the ridge line 20 formations in chicken wire 18 are now disposed in the horizontal valleys between the bricks 26. Finally, these valleys are pointed with grout 30, to embed the ridge line formations, as are the spaces between the ends of the bricks. This results in a composite structure of chicken wire, mortar, grout and bricks in which the bricks are keyed firmly in position against falling. Thus, the chicken wire is fixedly secured to the stucco wall by staples, some of which penetrate the stucco and pass into the studs, and it tenaciously ties all of the bricks together because it is embedded in the mortar which, in turn and along with the grout, serves to bond the bricks to the outer surface of the stucco wall. Because of this arrangement, even if the mortar behind some of the bricks should come loose from the wall, those bricks would not fall because the chicken wire maintains the integrity of the brickwork veneer. Such would not be the case if the bricks were merely attached to the wall with mortar in accordance with conventional building practices today.

As will be apparent to tile setters, masons, and others familiar with the installation of tiles, bricks or other facing units on building walls, my method of attaching such units to walls is quick, economical and cost effective. It does not require the skills of an experienced tile setter or mason, because almost anyone can butter bricks or tiles on one side and then easily place them in position with the aid of the parallel ridge lines in my chicken wire, or equivalent, backing material. Furthermore, as previously indicated, wall veneer skins constructed in accordance with the novel method of this invention are substantially more resistant to damage from the loss of individual tiles, bricks, etc. as the result of earthquakes, wind stresses and other abuses to which outside building walls can be subjected, than are conventionally constructed veneers. Another safety factor apparent in such veneer structures is their resistance to damage in the event of fire, even if a fireman has to direct a stream of cold water on the hot bricks or tiles. In the absence of my chicken wire or the equivalent in a veneer skin with such facing units, a thermal shock of this type would no doubt loosen and even dislodge some of the facing units from the walls.

Figure 4:
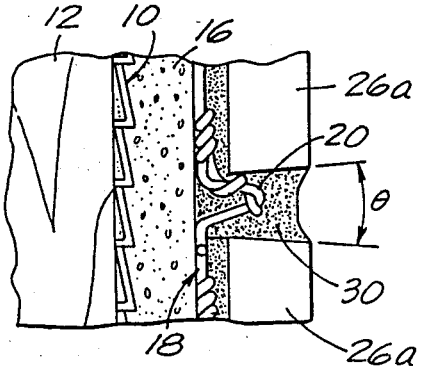
FIG. 4 is a fragmentary sectional view of a second embodiment of veneered wall in accordance with this invention illustrating the use of bricks with slightly tapering sides to enhance the keying effect of grout deposited therebetween.

Facing bricks, tiles, etc., conventionally have straight sides and ends, as illustrated in FIGS. 1 and 3. The side and end surfaces of such facing units are generally sufficiently rough to insure good bonding with the grout in the spaces between the units and thereby enhance the natural seal between the units and grout for good keying effect on the units. To enhance this keying effect even further, particularly where the units tend to have somewhat slick side and end surfaces, their sides and/or ends can be slightly tapered from the bottom out. Building bricks with sides of this type are illustrated in FIG. 4, which shows a joint between adjacent bricks in a veneered wall similar to that of FIG. 3 and an angle $\phi$ formed therebetween as a result of their tapering sides.

FIG. 5 shows a fragmentary section of chicken wire similar to that illustrated in FIG. 2 but with spaced dimples 32 formed therein for the purpose of permitting fastening of the wire to a wall surface in slightly spaced relationship with the wall. FIG. 6 shows a broken away part of a veneered stucco wall utilizing the FIG. 5 wire in accordance with the teachings herein and showing a pair of dimples 32 secured to the wall by means of a pair of staples 34. FIG. 7 is a fragmentary sectional view of the wall taken along line 7—7 of FIG. 6 and showing one of the staples 34 driven through the stucco and into a supporting wall stud 12*a*.

Figures 8, 9, 10:
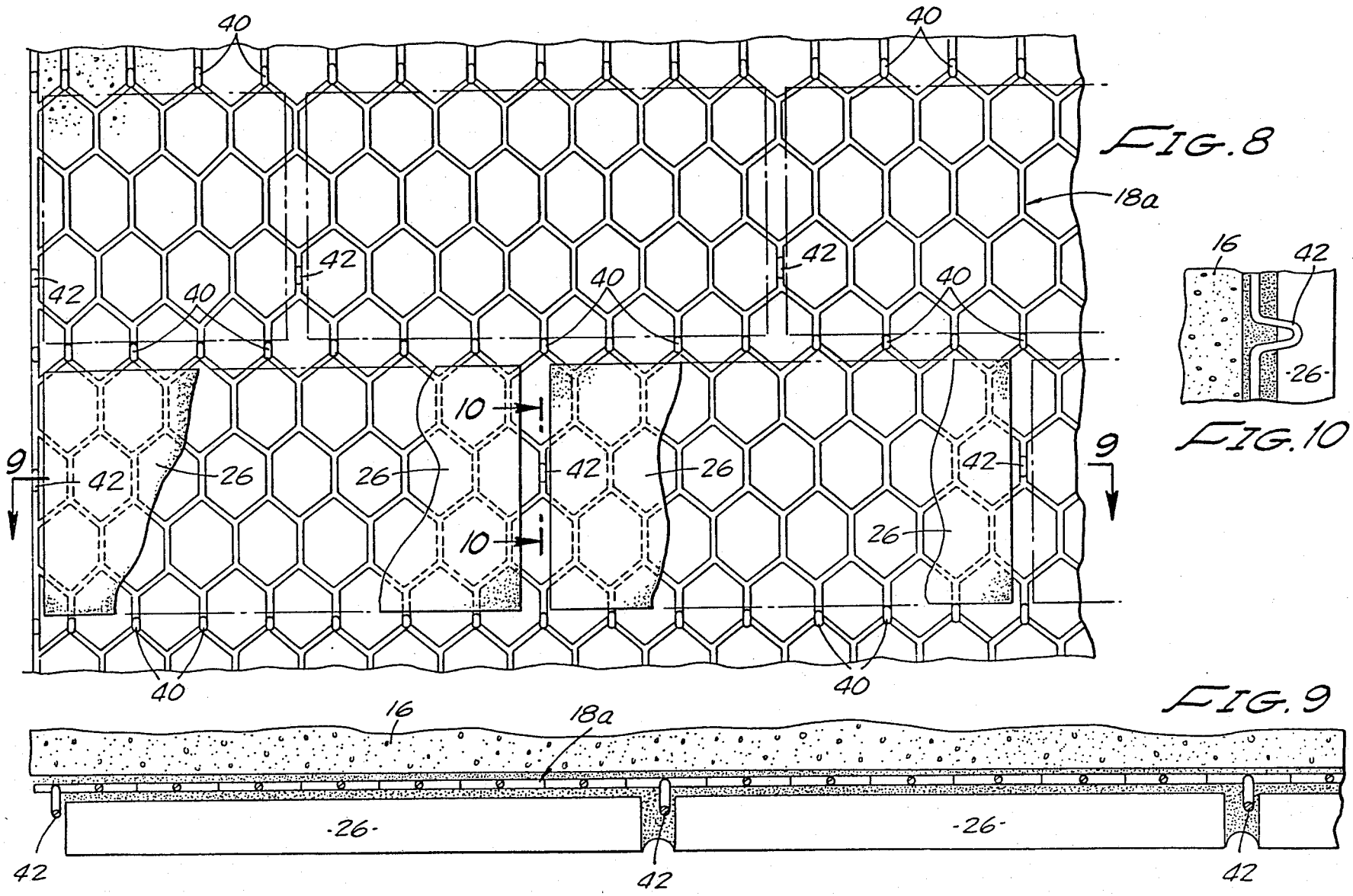
FIG. 8 is a fragmentary view of the face of a wall behind chicken wire similar to that in FIG. 1, the wire being schematically shown and formed with barriers to position brick facing units in a veneer skin on the wall, fragmentary portions of two such units being shown and other units being outlined in phantom lines for better illustration effect.
FIG. 9 is an enlarged fragmentary sectional view of the veneered wall of FIG. 8, taken along line 9—9 of FIG. 8.
FIG. 10 is an enlarged fragmentary sectional view of the completed wall taken along line 10—10 of FIG. 8.

FIG. 8 schematically shows a fragmentary section of chicken wire 18*a* with horizontal ridge lines formed by loops 40, similar to the ridge lines 20 in FIGS. 1 and 3, and additionally, loops 42 positioned at spaces between the ends of facing bricks 26 to be mounted on the wall by the method of this invention. The outlines of several of these bricks in two rows are shown to illustrate the manner in which they are positioned relative to one another. As in FIG. 1, the bricks are staggered from one horizontal row to the next. The ones in the upper row are shown in phantom lines and those in the lower row are shown partially broken away for better illustrative effect. FIG. 9 is an enlarged sectional view of a wall with the FIG. 8 arrangement of facing bricks thereon, taken along line 9—9 of FIG. 8. The FIG. 9 view shows three of the vertical loops 42 in section. FIG. 10 is a still further enlarged framentary sectional view of the wall, taken along line 10—10 of FIG. 8 and showing one of the vertical loops 42 in side view.

Figure 11:
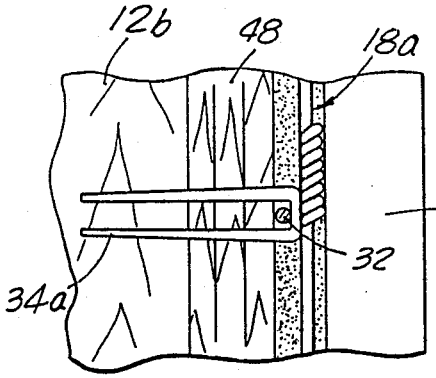
FIG. 11 is a view similar to FIG. 7, but showing the attachment of a veneer facing in accordance with this invention to a wooden surface rather than a stucco wall.

FIGS. 1 through 10 illustrate embodiments of my invention with emphasis on the installation of veneer facing units on conventional stucco walls, and the further use of chicken wire as the reinforcing mesh for the resulting veneer skin on such walls. But my method and the veneered wall resulting from that method do not, as previously indicated, require a stucco wall as a prerequisite. For example, my veneer facing can be installed on high rise buildings with steel frameworks through the use of self-tapping metal screws to anchor the reinforcing mesh thereto, on walls with plywood substrates, etc. FIG. 11 fragmentarily illustrates the attachment of my chicken wire reinforcing mesh to such a plywood substrate 48 with staples, one such being shown at 34*a*, as part of a brick veneer construction. This type of construction could, if desired, be employed internally, e.g., as a veneer for a fireplace or for a similar purpose. FIG. 11 is otherwise similar to FIG. 7, with a frame wall stud illustrated at 12*b*. The FIG. 11 chicken wire is of the type illustrated in FIG. 5 with dimples 32, one such being shown in section of FIG. 11. A facing brick is fragmentarily illustrated at 54 in FIG. 11.

Figure 12:
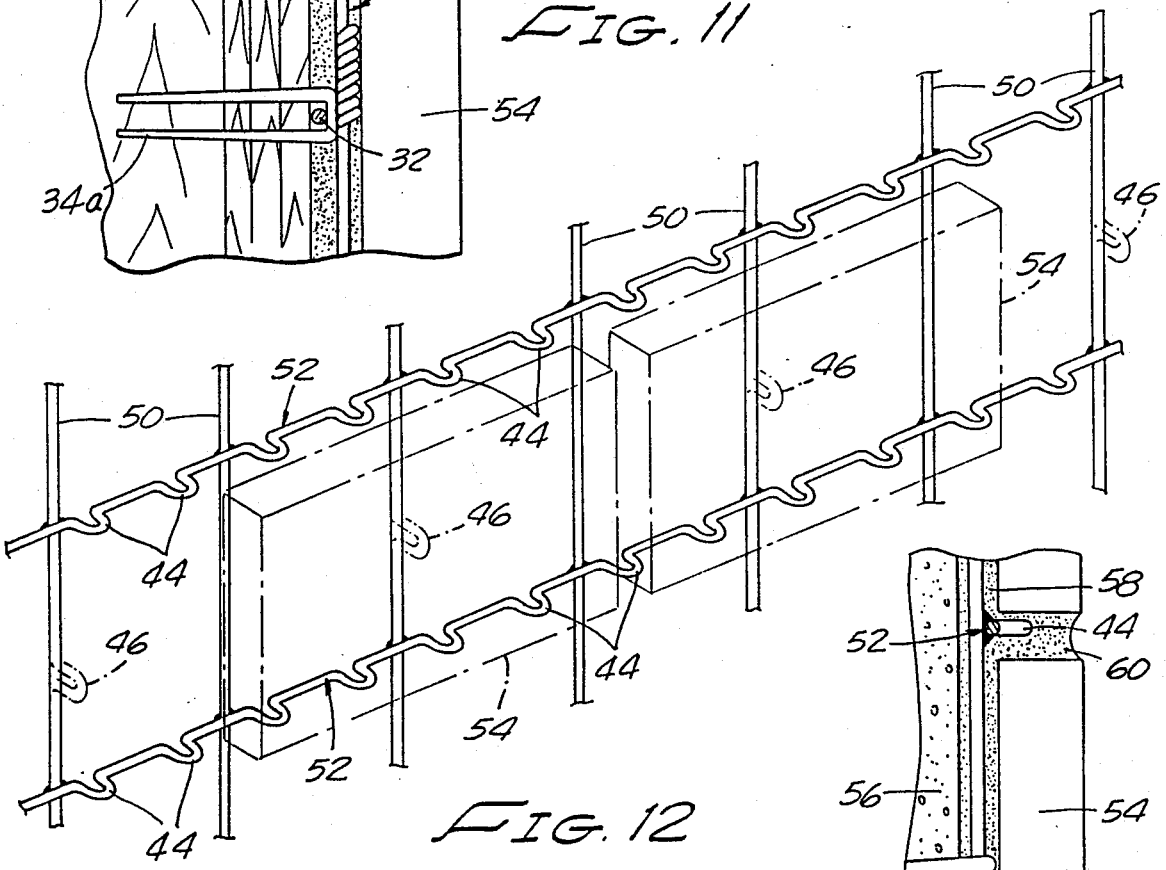
FIG. 12 is a fragmentary isometric view of a wire fabric with outwardly extending loops formed in parallel horizontal wires comprising a part thereof to bound spaces therebetween sized to receive bricks or the like in the veneering of a wall in accordance with this invention, two such bricks being shown in phantom lines in position on the fabric to illustrate this and loops on parallel vertical wires, forming a part of the fabric, being shown in phantom lines as optional barriers for additional orientation of facing units thereon.

FIG. 12 illustrates a different type of reinforcing mesh from those shown in the other drawings which is suitable for use in the method of this invention. This mesh consists simply of a plurality of crossing vertical and horizontal wires which form a grid pattern, the vertical ones being shown at 50 and the horizontal ones at 52 in the drawing. The horizontal wires are preferably spaced to receive bricks or other facing units therebetween, two such bricks being illustrated at 54 in phantom lines in FIG. 12. The crossing wires 50 and 52 are welded together at their points of intersection to form a unified whole, and each horizontal wire is provided with a plurality of outwardly extending loops or bends 56, spaced as illustrated. These bends 56 form barriers which define the upper and lower boundaries of spaces to receive the bricks 54 similarly to the way ridge lines 20 in chicken wire 18 of FIG. 1 form such barriers. As such, they provide a guide for placement of the bricks, which are fitted into the spaces between the horizontal wires resting on the bends of the lower ones in the practice of my method. This can easily be performed by an unskilled worker, and is preferably carried out in the same way the setting of bricks 26 is accomplished for the FIG. 3 wall, that is, by buttering the inner sides of the bricks with mortar and then pressing them into position with their lower edges just above the lower of its bounding horizontal wires 52. As will be apparent, the horizontal wires with their outwardly extending bends 56 are thus disposed in the spaces between the rows of bricks 54, and those spaces are next pointed with grout to cover those wires after the mortar holding the bricks to the wall has set. Here again, as in the case of chicken wire 18, properly spaced vertical wires of the FIG. 12 mesh can be provided with loops to demarcate spaces between the ends of facing bricks, such loops being indicated in phantom lines at 46 in FIG. 12. As will be apparent, the FIG. 12 mesh with the loops 46 accommodates facing bricks of different size than bricks 54. This is not a critical limitation however and the use of reinforcing mesh made to accommodate facing units of the same size whether or not barriers to horizontal movement of the units are present is within the scope of my invention. The vertical pattern of such barriers can, of course, vary depending upon the type and size of the facing units to be employed, whether the facing units are to be arranged in vertical alignment or staggered, etc.

Figure 14:
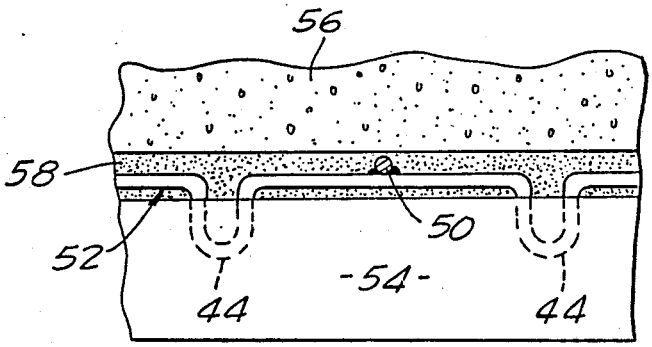
FIG. 14 is a still further enlarged fragmentary sectional view of the wall taken along line 14—14 of FIG. 13.
Figure 13:
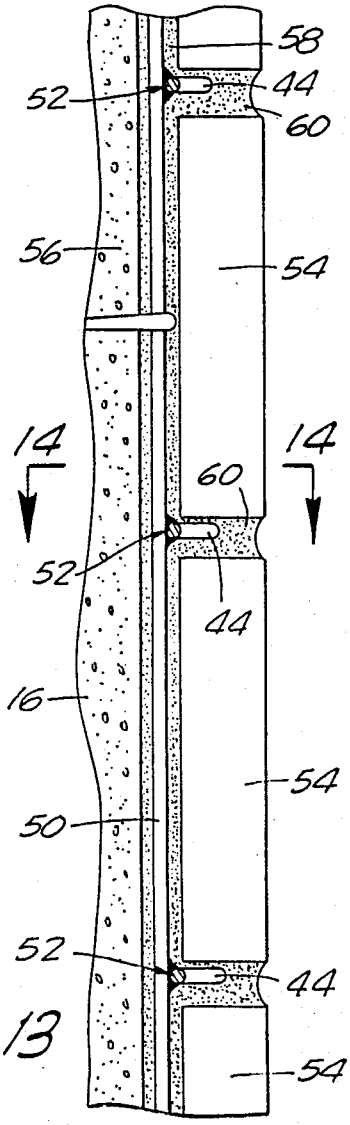
FIG. 13 is an enlarged fragmentary sectional view through a wall veneered in accordance with this invention utilizing the wire fabric of FIG. 12.

FIGS. 13 and 14 illustrate the use of the FIG. 12 reinforcing mesh in veneer facing on a stucco wall in accordance with this invention, the stucco being shown at 56 and the necessary mortar and grout at 58 and 60, respectively.

In summary, my method of attaching conventional bricks, tiles or other facing units to a building wall or the like can be practiced with unskilled workers to effect a substantial reduction in labor cost over the conventional ways of handling such work which require the skilled services of experienced tile setters or the like. In addition to permitting the use of unskilled labor, my novel method saves time, both in the actual installation of the facing units and in the elimination of the necessity of laying facing units in sections, as with the aid of removable grids temporarily attachable to a wall, and then waiting for the mortar holding the units in that section in place to set before proceeding to lay the units elsewhere. In one conventional method of setting or laying tiles, bricks, or other facing units on a building wall, a layer of bed mortar is spread on the wall, and the tiles then pressed into this layer in properly spaced relationship. After that, when the bed mortar has set, grout is introduced into the spaces between the units. This results in a slow, tedious and expensive procedure, as opposed to my novel method of laying tiles or the like, in which the starting of the work is not limited to any particular location, no removable grid is required for the work and the tiles or other units are simply buttered on one side and then pressed in proper position on the wall guided by boundary configurations in a reinforcing mesh attached to the wall. My novel veneer skins are strong and durable, with substantially no risk of falling tiles or the like therefrom to cause injury to persons below, property damage, etc., even in the event of fire, earthquake, or other destructive circumstances to which buildings can fall prey.

In summary, it is again emphasized that my invention is not limited to those specific features illustrated and described here, but only by the language of the following claims. To avoid confusion, the term "wall" will be used in the claims to denote any wall or structure of wall-like character that can be veneered in accordance with the method of this invention.

I claim:

1. A method of veneering a wall with a plurality of facing units, comprising:

fastening reinforcing mesh having a plurality of parallel outwardly extending ridge configurations to said wall, said ridge configurations being positioned to form horizontal barriers in the mesh, when so fastened which barriers define horizontally extending troughs sized to accommodate the facing units in horizontal rows flanked by said barriers;

mortaring the facing units in aligned positions in said troughs with their bottom edges oriented just above the lower ridge configurations of the troughs and the mortar embedding the reinforcing mesh therebehind and adhering to the wall; and subsequently pointing the spaces between said facing units with grout so that the grout embeds the ridge configuration barriers flanking the rows of facing units;

whereby said reinforcing mesh binds the resulting veneer construction together to prevent the fall of a facing unit even if its mortar bond with the wall comes loose.

2. A method in accordance with claim 1 in which the mortaring of said facing units to said wall is accomplished by back-buttering each of the facing units with mortar and then pressing it into proper position in one of said troughs.

3. A veneered wall comprising:

a wall;

a layer of reinforcing mesh having a plurality of parallel ridge configurations defining elongate troughs therebetween;

fastening means holding said reinforcing mesh against said wall with the elongate troughs horizontally disposed;

a plurality of facing units disposed in rows in said elongate troughs, said rows being flanked by said ridge configurations;

mortar disposed between said facing units and said wall and embedding said reinforcing mesh behind said units; and groud disposed between said facing units and embedding said ridge configurations.

4. A veneered wall in accordance with claim 3 in which said reinforcing mesh is chicken wire.

5. A veneered wall in accordance with claim 4 in which said chicken wire is 1-inch, 20-gauge chicken wire.

6. A veneered wall in accordance with claim 5 in which said chicken wire is in mostly spaced apart relationship with said wall.

7. A veneered wall in accordance with claim 6 in which said wall is a stucco wall and said facing units are bricks.

8. A veneered wall in accordance with claim 3 in which said reinforcing mesh includes outwardly extending barrier configurations disposed in spaces between horizontally separated facing units in said rows.

9. A veneered wall in accordance with claim 3 in which said reinforcing mesh is wire fabric comprising a plurality of 90° angles and disposed vertically and horizontally;

said ridge configurations comprising spaced, outwardly extending loops in the horizontally disposed wires.

10. A veneered wall in accordance with claim 9 in which said wire fabric includes outwardly extending loops in the vertically disposed wires forming barriers disposed in spaces between horizontally separated facing units in said rows.

11. A veneered wall in accordance with claim 3 in which said facing units are tiles.

12. A veneered wall in accordance with claim 3 in which said facing units are bricks.

13. A veneered wall in accordance with claim 3 in which said wall is a stucco wall.

14. A veneered wall in accordance with claim 13 in which said facing units are bricks.

15. A veneered wall in accordance with claim 3 in which said reinforcing mesh is in mostly spaced apart relationship with said wall.

* * * * *